US007585004B1

(12) United States Patent
Page

(10) Patent No.: US 7,585,004 B1
(45) Date of Patent: Sep. 8, 2009

(54) NECKTIE KNOT TYING TOOL

(76) Inventor: Raymond G. Page, 9842 B Daisy Mist La., Houston, TX (US) 77038

( * ) Notice: Subject to any disclaimer, the term of this patent is extended or adjusted under 35 U.S.C. 154(b) by 0 days.

(21) Appl. No.: 12/157,283

(22) Filed: Jun. 9, 2008

(51) Int. Cl.
*D03J 3/00* (2006.01)

(52) U.S. Cl. ..... 289/17

(58) Field of Classification Search ..... 289/17; 223/27; 2/144, 145, 148
See application file for complete search history.

(56) References Cited

U.S. PATENT DOCUMENTS

| | | | | |
|---|---|---|---|---|
| 2,434,821 | A | | 1/1948 | Ulrich |
| 2,669,724 | A | | 2/1954 | Jarrett |
| 3,026,530 | A | | 3/1962 | Gruber |
| 3,837,691 | A | * | 9/1974 | Smythe ..... 289/17 |
| 4,173,793 | A | | 11/1979 | Kazuo |
| 4,815,772 | A | | 3/1989 | Lizarraga |
| 5,416,926 | A | | 5/1995 | Koy |
| 5,562,456 | A | * | 10/1996 | Cianciotto ..... 434/260 |
| 5,584,075 | A | | 12/1996 | Bae et al. |
| 5,983,461 | A | | 11/1999 | Chen |
| 6,120,068 | A | | 9/2000 | DiPietro |
| 6,687,915 | B2 | | 2/2004 | Kear |
| 6,983,961 | B2 | | 1/2006 | Aduana, Jr. et al. |

* cited by examiner

*Primary Examiner*—Shaun R Hurley
(74) *Attorney, Agent, or Firm*—Mary J. Gaskin

(57) ABSTRACT

A knot tying tool and support form which assists a person in tying a perfectly-formed necktie knot. The Y-shaped tool has two arms and a handle with a slot for insertion of the tail end of a necktie. It is molded from a lightweight plastic material, and it remains within the knot after the knot is tied, without being noticeable or bulky. The tool can be molded with a raised area that pushes out the center of the knot.

6 Claims, 7 Drawing Sheets

NECKTIE KNOT TYING TOOL

FIELD OF THE INVENTION

This invention relates to neckties and to a tool for tying a necktie knot and supporting the necktie knot formed thereby.

BACKGROUND OF THE INVENTION

A necktie is a long strip of fabric with a wider head portion and a narrower tail end. After the necktie is tied around a wearer's neck, the necktie ideally will have a knot with a generally triangular shape, and the head portion will cover the tail portion of the necktie. Neckties occupy an important part of a man's wardrobe. They are always used with a business suit and often are the most memorable accessory a man can wear, as neckties are made in a variety of patterns and colors, reflecting the wearer's taste. As a result, the tie must be properly tied so that the knot is aesthetically pleasing, with a neat, balanced, and uniform shape.

Unfortunately, the tying of such knots seems to have become a lost art, and necktie wearers find themselves often having to retie knots, sometimes repeatedly, to form a satisfactory knot. As a result, more and more men have turned to clip-on ties with pre-formed knots. However, such ties have an artificial appearance and are provided in a limited choice of colors and fabrics.

Other devices have been proposed for supporting or forming necktie knots, including various hangers, hooks, zippers, and chains. Some of the devices are part of a necktie "package," some remain in the knot, and some are removed after a knot is tied. However, all have drawbacks; some are complicated or cumbersome, others result in a bulky knot, and still others are uncomfortable to wear. None of the prior art devices has the simplicity and advantages of the present invention.

SUMMARY OF THE INVENTION

The knot tying tool of the present invention is designed to assist a person with tying a perfect Windsor knot with a neat, balanced, and uniform shape. The tool remains within the knot while the tie is worn, where it provides support for the finished knot.

The tool is generally Y-shaped, with two arms of uniform length, width and thickness, attached to a handle with a vertical slot for insertion of the tail end of a necktie. The tool has generally flat arms, with the handle configured with a slight curvature (towards the wearer's body).

The tool is molded from a lightweight plastic material, such as polyethylene. It can be made in different sizes, depending on the length of the necktie and the size of the knot preferred.

An object of the present invention is to provide a tool which is easy to use, yet allows a user to tie a perfect knot.

Another object of the present invention is to provide a lightweight, inexpensive tool to facilitate tying of a perfect knot on the first try, without the need to retie the knot.

Yet another object of the present invention is to provide a tool that has a raised area to make the center of the knot "stand out."

A still further object of the present invention is to provide a tool that is not noticeable to the wearer or to others when it is present within a necktie knot.

DESCRIPTION OF PREFERRED EMBODIMENT

Figure 1:
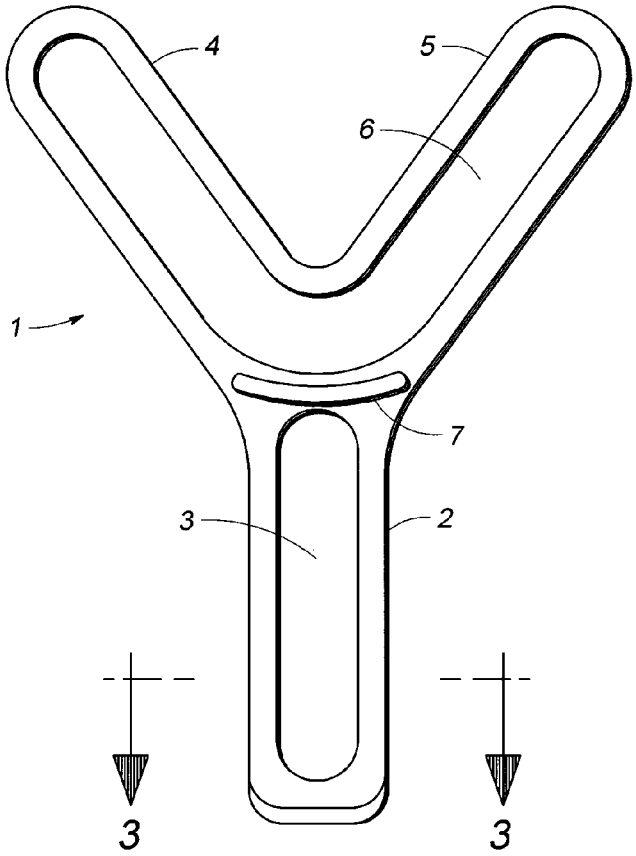
FIG. 1 is a front plan view of the knot tying tool of the present invention.

As shown in FIG. 1, the necktie knot tying tool 1 of the present invention is generally Y-shaped, with a handle 2 having a slot 3 formed therein. The slot 3 is sized to hold the tail of a necktie. Extending upwards from the handle 2 are arms 4 and 5, which form a V-shaped notch between them. The arms 4 and 5 are typically formed with a V-shaped hollowed-out area 6, which helps keep the tool 1 light in weight and slightly flexible. The arms 4 and 5 are equal in length, width, and thickness. A ridge 7 formed on the body of the tool 1 between the handle 2 and the arms 4 and 5 pushes out the center of a knot formed with the tool 1. The tool 1 is generally molded from a lightweight plastic material, such as polyethylene. It can be made in different sizes, depending on the length of the necktie and the size of the knot preferred. Typical tools can vary from approximately 2¼ inches to 3 inches in length, and from approximately 1½ to 2¼ in width at the widest point. The tool 1 is molded with rounded, smooth edges, so that no pulled threads or runs in the tie will result from its use.

Figure 2:
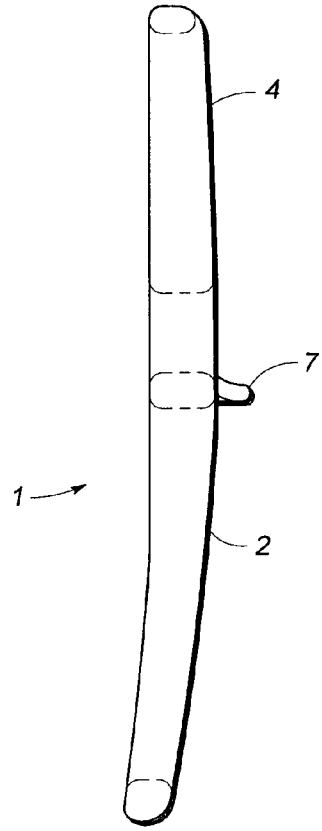
FIG. 2 is a side plan view of the knot tying tool of the present invention.

As shown in FIG. 2, the tool 1 has generally flat arms 4, (5) while the handle 2 is configured with a slight curvature (towards the wearer's body). The upper end and the lower end of the tool 1 are slightly less thick than the middle portion of the tool 1, which is approximately one-fourth inch thick. The ridge 7 is a raised area on the front of the tool 1, which pushes out the center of the knot formed with the tool 1.

Figure 3:
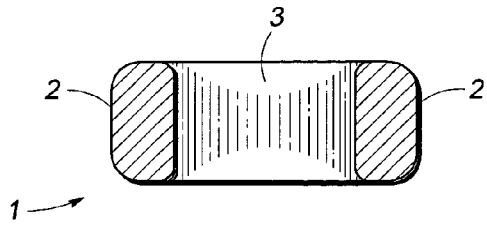
FIG. 3 is a cross-sectional view of the handle and slot, taken along line 3-3 shown in FIG. 1.

The cross-sectional view of FIG. 3 shows the handle 2 of the tool 1, with the slot 3 formed therein. The slot 3 is wide enough to accommodate insertion of the tail end of the tie.

Figure 4:
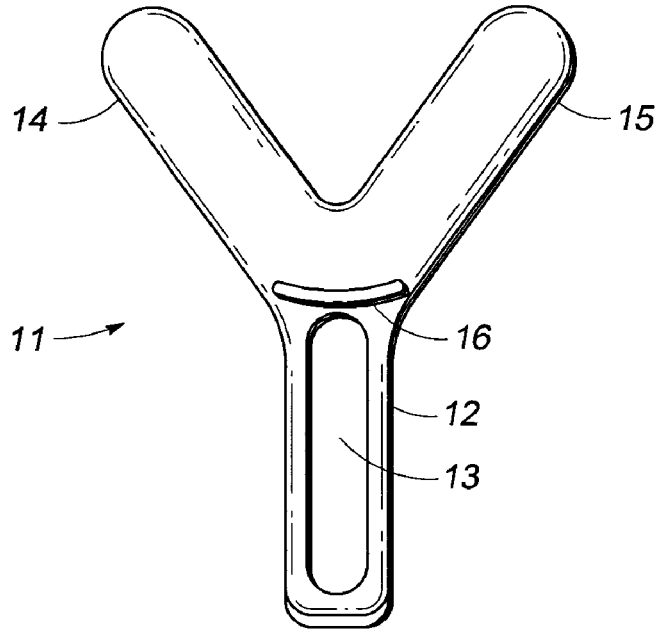
FIG. 4 is a front plan view of an alternate embodiment of the present invention.

FIG. 4 shows an alternate embodiment of the knot tying tool 11, which is molded with a handle 12 having a slot 13, arms 14 and 15, and ridge 16. The arms 4, 5 are solid. This embodiment should be less expensive to mold than the tool 1 shown in FIG. 1, but it will likely be slightly heavier.

Figure 5:
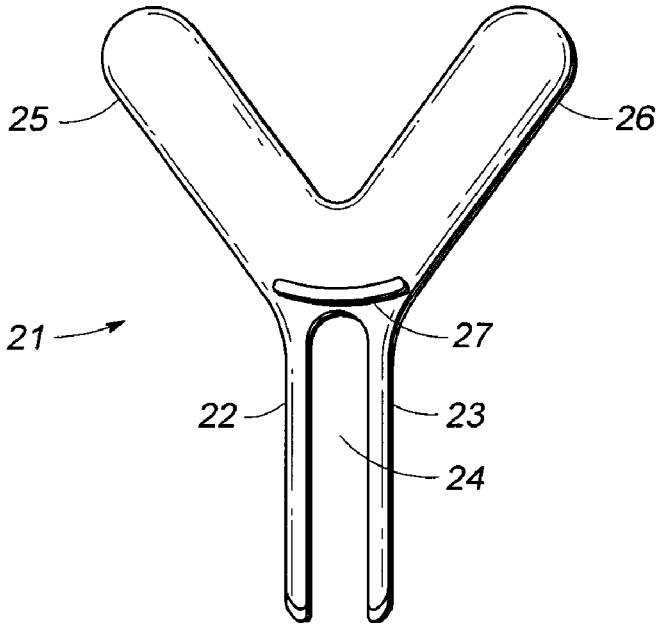
FIG. 5 is a front plan view of yet another alternate embodiment of the present invention.

FIG. 5 shows an alternate embodiment of the knot tying tool 21, which is molded with legs 22 and 23 having an open slot 24 between them. It would likely be molded with solid arms 25 and 26, like the embodiment shown in FIG. 4, with ridge 27. In use, the tail end of the tie would be pulled into the slot 24, rather than slid into the slot 3 or 13, as shown in FIG. 1 and FIG. 4.

Figure 6A:
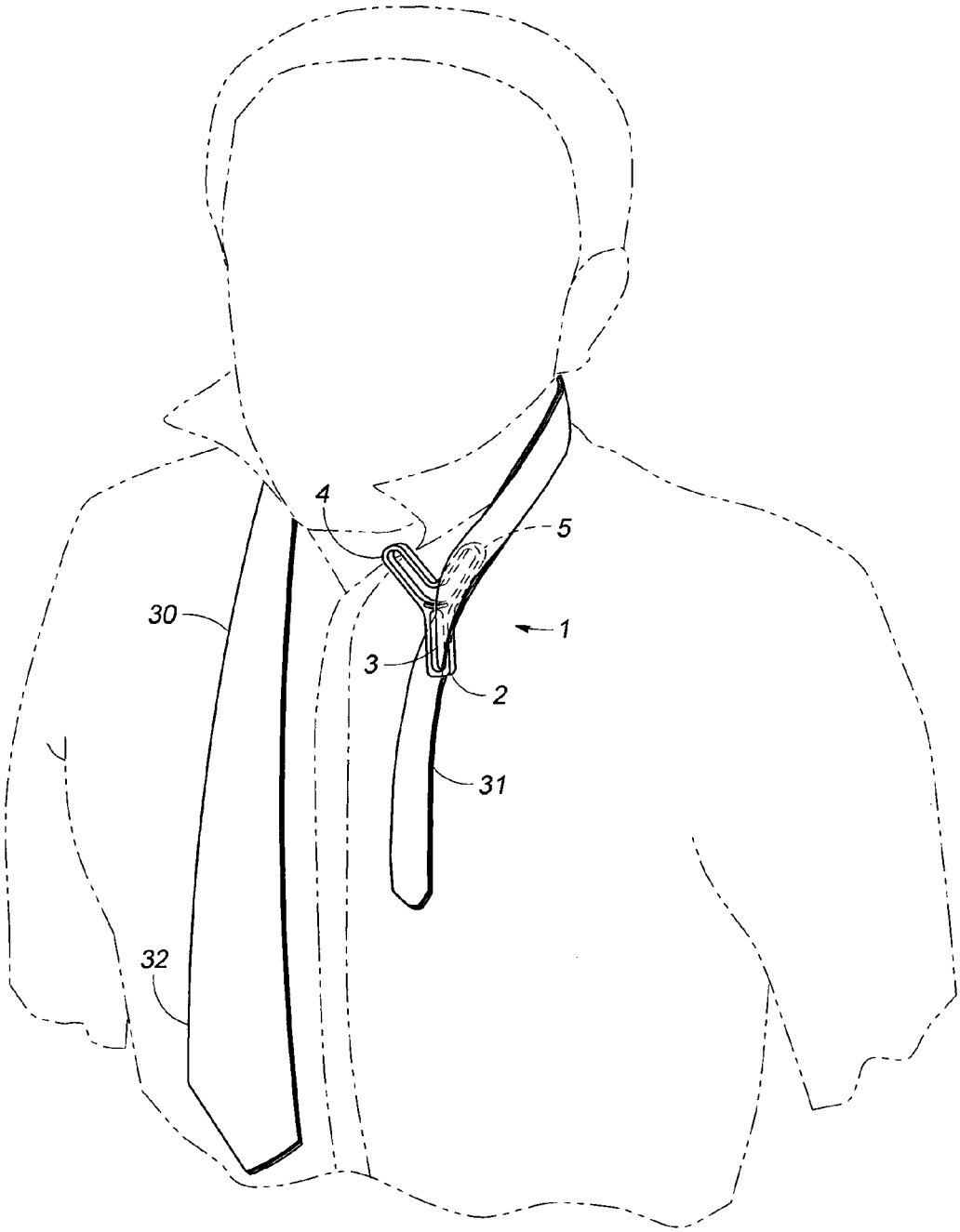
FIGS. 6A-E are a series of perspective views showing how the knot tying tool is used to aid in the tying of a perfect knot.
Figure 6B:
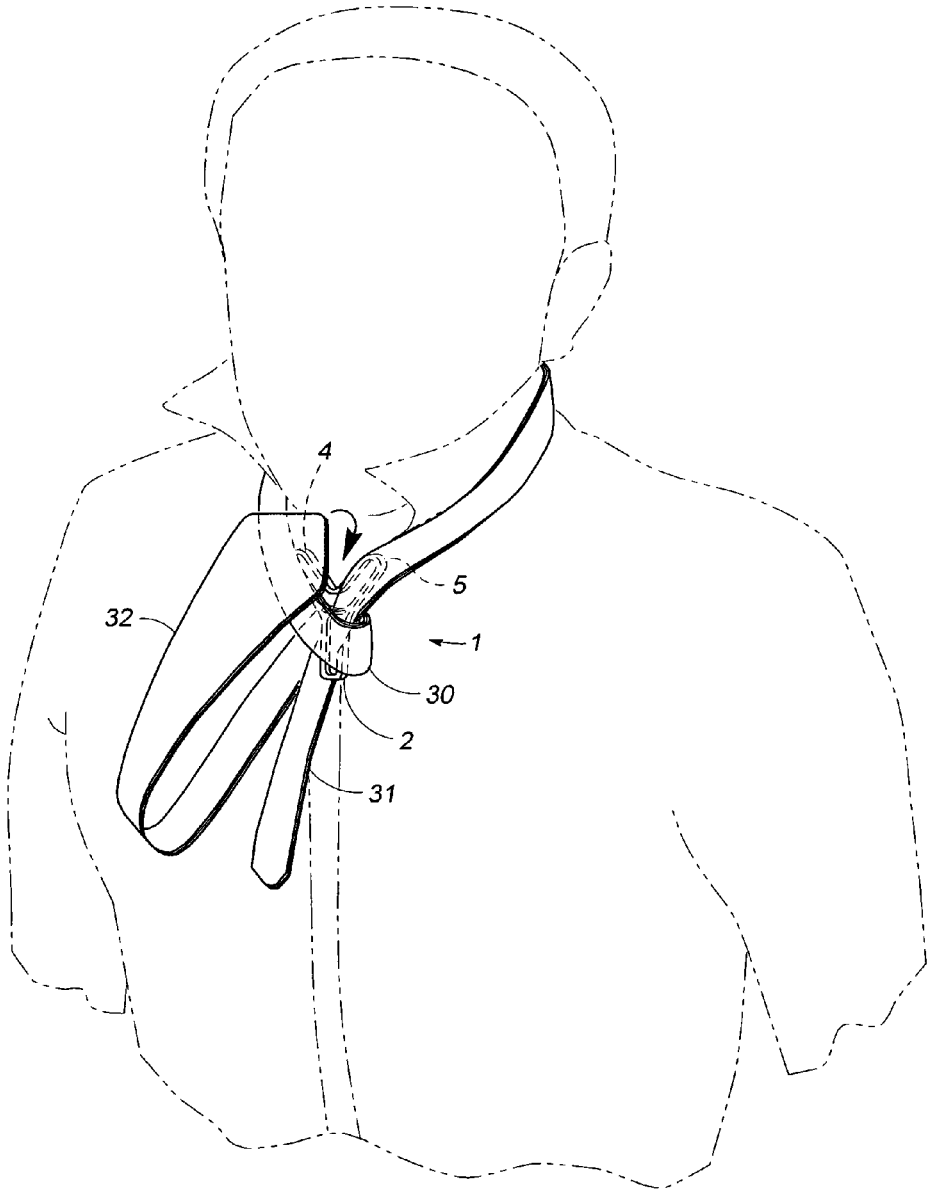
Figure 6C:
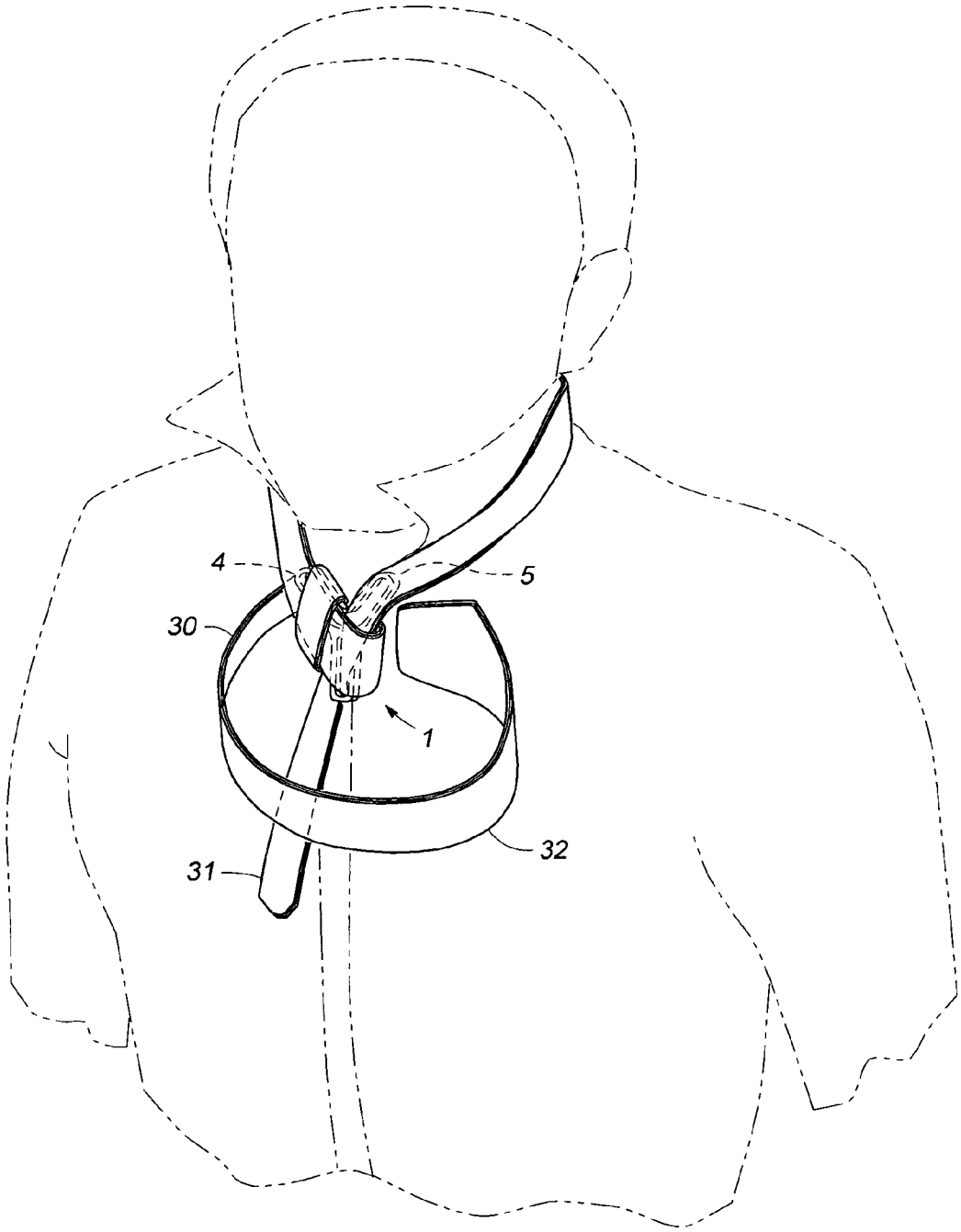
Figure 6D:
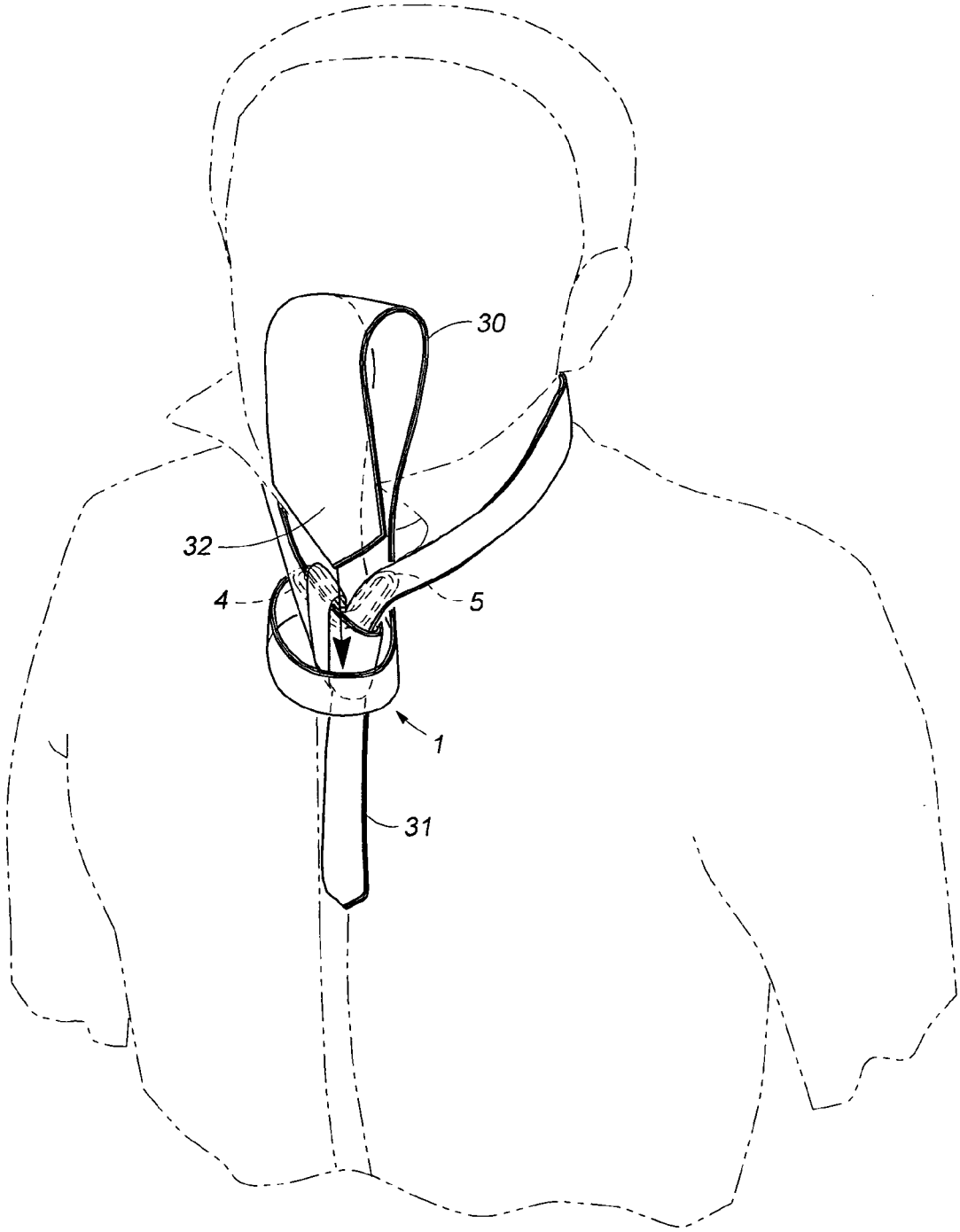
Figure 6E:
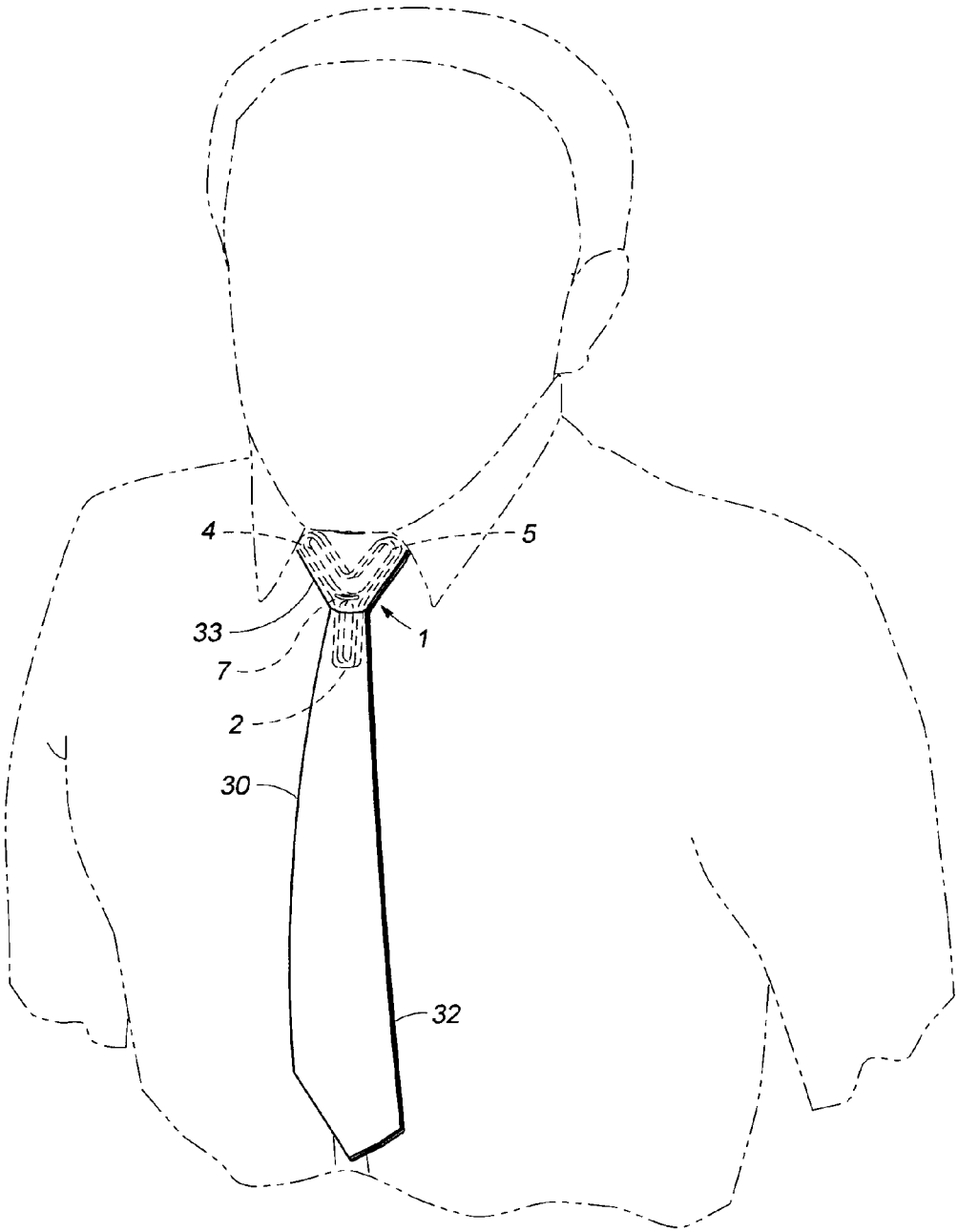

FIGS. 6A through 6E show how the knot tying tool 1 of the present invention is used. As shown in FIG. 6A, a necktie 30 is placed around the wearer's neck, with the tail end 31 over the wearer's left side hanging approximately 12 to 18 inches shorter than the wider head 32 of the necktie 30. Because the tail end 31 stays in place, the head 32 will never end up too short, and no retying will be necessary. Pull the tail end 31 through the slot 3 in the handle 2, from the front to the back, over the arm 5 of the tool 1, and pull the tool 1 up towards the neck. Make sure the arm 5 of the tool 1 stayed covered. As shown in FIG. 6B, cover arm 4 with the necktie 30, pulling the necktie 30 across the front of the tool 1, to the side of the tool 1, then around its back side, bringing the necktie 30 along the side of the tool 1 with arm 4. Take the head 32 of the necktie 30 up and pull it over the arm 4 of the tool 1 from the front, covering arm 4 with another layer of material, then bring the head 32 down through the notch between arms 4 and 5. As shown in FIG. 6C, pull the necktie 30 out to the side of arm 4, thereby wrapping arm 4 firmly, and then bring the head 32 across the front of the tool 1 to the side of the tool 1 with arm 5. As shown in FIG. 6D, pull the head 32 of the necktie 30 to the back of the tool 1 behind arm 5, then bring it straight up between the arms 4 and 5, then bring the head 32 of the necktie 30 straight down over the front of the tool 1, over the notch between the arms 4 and 5, and downwards behind the loop of necktie 30 (created in FIG. 6C, which is typically held open with an index finger) and over the tail end 31. As shown in FIG. 6E, the head 32 of the necktie 30 has been pulled down evenly until it is the appropriate length and holds the tool 1 firmly in place. The knot 33 that has been formed can be tightened according to preference. The necktie 30 conceals the handle 2 and the arms 4 and 5 of the knot tying tool 1. The ridge 7 pushes the center of the knot 33 forward and keeps it from flattening out.

Although the knot tying tool of the present invention has been described with reference to preferred embodiments, it will be understood, by those skilled in the art, that additions, modifications, substitutions, deletions and other changes not specifically described are possible, and that the details herein are to be interpreted as illustrative and not as self-limiting.

I claim:

1. A necktie knot tying tool for use with an elongate necktie having a head and a tail, the tool remaining inside the knot after tying, the tool comprising a generally Y-shaped body having:

(a) a front;

(b) a back;

(c) an upper portion having a first arm and a second arm forming a V-shaped notch; and (d) a lower portion having a handle having a vertical slot formed therein, the slot sized for receiving the tail of the necktie, (e) an upraised area on the front side of the body of the tool between the upper portion and the lower portion of the tool.

2. The tool of claim 1 wherein the first arm and the second arm are formed with a V-shaped hollow area.

3. The tool of claim 1 wherein the tool is molded from polyethylene.

4. The tool of claim 1 wherein the upper portion of the body of the tool is substantially flat and the lower portion of the body of the tool is configured to curve slightly towards the back of the tool.

5. The tool of claim 1 wherein the slot in the handle is formed by two spaced-apart legs.

6. A method for forming a necktie knot comprising the steps of:

(a) providing a Y-shaped knot tying tool having a handle with a vertical slot, the tool further having a first arm and a second arm forming a V-shaped notch therebetween, the tool still further having a front, a back, a first side and a second side;

(b) placing a necktie having a head and a tail end around a wearer's neck under the wearer's shirt collar with the tail end hanging 12 to 18 inches shorter than the head of the necktie;

(c) pulling the tail end of the necktie over the second arm of the tool and through the slot in the handle from the front to the back of the tool and moving the tool towards the wearer's neck;

(d) covering the first arm with the necktie while pulling the necktie across the front of the tool to the second side of the tool, leaving a loop, then around the back of the tool, then along the first side of the tool;

(e) bringing the head of the necktie up and over the first arm of the tool through the notch formed between first arm and the second arm, covering the first arm of the tool;

(f) pulling the head down and out alongside the first side of the tool;

(g) bringing the head across the front of the tool, to the second side, and then to the back of the tool behind the second arm;

(h) bringing the head of the necktie straight up between the first arm and the second arm;

(i) bringing the head of the necktie down over the notch between the first arm and the second arm;

(j) bringing the head of the necktie down over the front of the tool, behind the loop formed in step (d), and over the tail end of the necktie;

(k) arranging the head of the necktie to cover the tail end of the necktie;

(l) tightening the necktie knot.

* * * * *